US008435177B2

(12) United States Patent
Lanfermann et al.

(10) Patent No.: US 8,435,177 B2
(45) Date of Patent: May 7, 2013

(54) PROCESS AND SYSTEM FOR MONITORING EXERCISE MOTIONS OF A PERSON

(75) Inventors: Gerd Lanfermann, Aachen (DE); Edwin Gerardus Johannes Maria Bongers, Eindhoven (NL); Nicolaas Lambert, Eindhoven (NL); Victor Martinus Gerardus Van Acht, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 424 days.

(21) Appl. No.: 12/671,733

(22) PCT Filed: Jul. 31, 2008

(86) PCT No.: PCT/IB2008/053079
§ 371 (c)(1),
(2), (4) Date: Feb. 2, 2010

(87) PCT Pub. No.: WO2009/019638
PCT Pub. Date: Feb. 12, 2009

(65) Prior Publication Data

US 2010/0234699 A1 Sep. 16, 2010

(51) Int. Cl.
*A61B 5/00* (2006.01)
*A63B 69/00* (2006.01)
*A63B 23/00* (2006.01)

(52) U.S. Cl.
USPC ..... 600/301; 434/247; 482/148

(58) Field of Classification Search ..... None
See application file for complete search history.

(56) References Cited

U.S. PATENT DOCUMENTS

| | | | | |
|---|---|---|---|---|
| 4,337,049 | A | 6/1982 | Connelly | |
| 4,790,528 | A * | 12/1988 | Nakao et al. | 482/9 |
| 5,372,365 | A | 12/1994 | McTeigue et al. | |
| 6,210,301 | B1 | 4/2001 | Abraham-Fuchs et al. | |
| 6,778,866 | B1 | 8/2004 | Bettwy | |
| 7,558,622 | B2 * | 7/2009 | Tran | 600/509 |
| 2004/0176226 | A1 | 9/2004 | Carlson | |
| 2006/0025282 | A1 | 2/2006 | Redmann | |
| 2008/0262323 | A1 * | 10/2008 | Gerber et al. | 600/301 |
| 2009/0318779 | A1 * | 12/2009 | Tran | 600/301 |

FOREIGN PATENT DOCUMENTS

WO 2005114616 A1 12/2005

* cited by examiner

*Primary Examiner* — Henry M Johnson, III
*Assistant Examiner* — Shirley Jian

(57) ABSTRACT

The present invention relates to a process and a system for monitoring exercise motions of a person. The process comprises monitoring a first sensor signal from the person. While the first sensor signal does not deviate from a first sensor signal template by more than a pre-determined amount, signals from further sensors from the person are monitored, compared to templates processing and the comparison result is evaluated. If unit sensor signals deviate from the templates by more than a pre-determined value this is communicated to the person.

15 Claims, 2 Drawing Sheets

PROCESS AND SYSTEM FOR MONITORING EXERCISE MOTIONS OF A PERSON

BACKGROUND OF THE INVENTION

Exercising at home is a good way to gain or regain mobility and to battle conditions, for example lower back pain. A wealth of exercises is documented in books and the internet, describing the exact execution of these workouts. A majority of these exercises needs to be done in an exact way, for otherwise the movement does not stimulate or train the muscle groups that it is intended for. Controlling the execution of exercises is usually done by a trainer person. However, for home training this is not feasible.

U.S. Pat. No. 6,210,310 B1 discloses a patient monitoring system, particularly for orthopedics. It is designed to be used by the medical layman and provides this person with information relating to the exercises or activities he performs. To this end, a sensor array produces sensor signals which are stored in a first memory and are compared to the contents of a second memory (ideal signal pattern). The comparison result is made available to the user via a display or as a biofeedback.

However, this system is not equipped to discriminate between important and less important sections of the exercises. For the success of an exercise it may be necessary to pay more attention to certain aspects as they might influence body mechanics and muscle function in other parts of the body as well.

Despite this effort therefore there is a need in the art for a more detailed way that a person's exercises can be monitored. It is thus an object of the present invention to provide such a process and a system for monitoring exercise motions of a person.

SUMMARY OF THE INVENTION

To achieve this and other objects the present invention is directed to a process for monitoring exercise motions of a person, comprising the steps of:

a) selecting a first sensor signal; the first sensor signal being assigned to the person and originating from a first sensor being selected from the group comprising movement sensors, physiological activity sensors, muscle activity sensors and/or respiratory sensors;

b) monitoring the first sensor signal and comparing the first sensor signal to a first sensor signal template;

c) while the first sensor signal does not deviate from the first sensor signal template by more than a pre-determined value, firstly monitoring signals from at least one further sensor assigned to the person and being selected from the group comprising movement sensors, physiological activity sensors, muscle activity sensors and/or respiratory sensors;

secondly comparing the signals from the at least one further sensor to sensor signal templates representing exercises the person is performing; and thirdly evaluating the comparison result;

d) communicating to the person undertaking the exercise when the first sensor signal deviates from the first sensor signal template by more than a pre-determined value; and e) communicating to the person undertaking the exercise when the signals from the at least one further sensor deviate from the sensor signal templates representing exercises the person is performing by more than a pre-determined value.

With a system for monitoring the exercise motions according to the present invention the attention of the person is directed towards those aspects of the exercise that are especially important for the overall benefit of the exercise.

DETAILED DESCRIPTION OF THE INVENTION

Before the invention is described in detail, it is to be understood that this invention is not limited to the particular component parts of the devices described or process steps of the methods described as such devices and methods may vary. It is also to be understood that the terminology used herein is for purposes of describing particular embodiments only, and is not intended to be limiting. It must be noted that, as used in the specification and the appended claims, the singular forms "a," "an" and "the" include singular and/or plural referents unless the context clearly dictates otherwise. Thus, for example, reference to "a sensor" may include several sensors, and the like.

With respect to the process according to the present invention, step a) firstly involves selecting a first sensor signal. This first sensor signal can be seen as a lead signal. The selection can be done manually by a user or automatically. The selection is based upon the type of exercise that is to be performed and should represent one or more parameters that are important for the success of the entire exercise. For example, certain exercises require that the hip of the person remains steady. Then the first sensor signal could be a signal from a motion sensor indicating sway or rotation of the hip. In other exercises, it may be required that the person is breathing regularly or breathing in at certain parts of the exercise and breathing out at other parts. Then the first sensor signal could be a signal indicating respiratory motion of the person. Another example would be an isometric exercise where certain muscles need to be contracted throughout the exercise. Then the first sensor signal could be an electromyographical (EMG) signal from these muscles. Depending on the type of exercise, more than one first sensor signals can be selected if this is important for the exercise.

The person carries sensors that assess his movement and, in connection with that, the orientation of the person's limbs in space. Further sensors include physiological activity sensors that can give information about the overall state of the person, for example if the person is fatigued. Muscle activity sensors determine when a muscle is contracted. Respiratory sensors determine if the person is breathing in, breathing out or holding his breath.

Step b) involves monitoring the first sensor signal and comparing the first sensor signal to a first sensor signal template. Sensor signal templates describe how the signal of the sensor should be if the exercise is performed correctly, As the exercise is performed in a certain time, the sensor template will also describe the temporal variation or non-variation of the sensor signal. A template may represent one sensor signal or a group of sensor signals. Within a group of signals in a template, it is still possible to access an individual signal for comparison. The comparison of the sensor signal with the template seeks to determine the amount of deviation of the real signal from the ideal signal.

In step c) a procedural loop is being executed, the loop condition being that the first sensor signal does not deviate from the first sensor signal template by more than a pre-determined value. The pre-determined value determines how much deviation from an ideal signal is regarded as acceptable so that the exercise will still be beneficial to the person.

The first step within the procedural loop is monitoring signals from at least one further sensor assigned to the person and being selected from the group comprising movement sensors, physiological activity sensors, muscle activity sensors and/or respiratory sensors. These sensors represent other actions of the person during the exercise such as moving limbs, breathing in our out or contracting muscles. In connection with the first sensor signal these sensor signals represent the actions of the person in the complete exercise.

The second step within the procedural loop is comparing the signals from the at least one further sensor to sensor signal templates representing exercises the person is performing. Deviations are also calculated in order to assess the correct execution of the exercise. The signals of the sensors within this loop as well as the first sensor signals can be recorded.

The third step within the procedural loop is evaluating the comparison result. An evaluation can be in the form of counting how often a certain movement is performed. It can also be in the form of determining how much the average deviation of the sensor signals from the templates is. As a result of the loop structure, the evaluation will only take place when the first sensor signal does not deviate from the first sensor signal template by more than a pre-determined value.

For example, in a simple exercise the lifting of an arm along a certain path while the person does not tilt his chest in the opposite direction is required. A first sensor signal could be from a sensor placed on the chest and indicating the angle of the person's longitudinal axis relative to the ground, a person standing upright in a normal fashion displaying such an angle of 90°. The sensor signal template could be that this angle is 90° throughout the exercise with a pre-determined value for acceptable deviation of 5%. The person then lifts his arm along the required path. While the person does not tilt his chest by more than the acceptable 5% the lifting of the arm is monitored by further sensors and the sensor signals are compared to the appropriate template. Furthermore, only while the person's chest is not tilted by more than the acceptable 5% a template-conforming lifting of the arm will be counted.

Steps d) and e) serve to warn the person that the exercise is not being performed correctly. The warning can be communicated to the person in the form of vibrational, optical or audio signals, for example in speech form. It is possible that the communication of step e) is only undertaken within the loop of step c), that is, that the communication of step e) will only take place as long as the first sensor signal does not deviate from the first sensor signal template by more than a pre-determined value.

An embodiment of the process according to the present invention further comprises after step e) the following step:

f) comparing the signals to a signal template and identifying whether a condition indicating the end of the exercise has been met.

To this end, the sensor signals are compared to appropriate templates. Examples for indications for the end of the exercise are that the person is standing up or that the person is lying down. It may also be determined that an exercise is over when a violation of multiple thresholds has occurred simultaneously. In general, this is advantageous as it allows for the correct execution of repetitive sets of exercises.

In a further embodiment of the process according to the present invention the exercise is determined not to have commenced if physiological data from the person exceed a pre-determined limit. The physiological data is supplied from physiological activity sensors and may be data on the pulse rate, the fact that the person is sweating, that the person's heart is beating irregularly, the person's blood pressure is too high or other indicators that further exercise is not recommended. For example, a pre-determined limit may be that the person should not exercise with a pulse rate of over 120, 130 or 140 beats per minute. In general, it can be further communicated to the person that such a pre-determined limit has been exceeded. It is advantageous to set such limits so that the person is prevented from harming himself when exercising at an inappropriate moment or when the person is already fatigued.

In a further embodiment of the process according to present invention the pre-determined value in step c), d) and/or e) varies in magnitude over the course of the exercise. This especially relates to the first sensor signal. For example, it may be determined that in the beginning phase of the exercise a deviation of a sensor signal of 10% from the ideal value is tolerable, whereas in the middle of the exercise only a deviation of 5% would still ensure an overall benefit of the exercise to the person. The variation in magnitude may apply in the same manner to all signals of the template or each signal can have its individual variation. A benefit of varying the acceptable magnitude of deviation from the ideal value is that the person can focus on the important parts of the exercise without being distracted by threshold violation warnings during less significant sections of the exercises.

In a further embodiment of the process according to the present invention the magnitude of the pre-determined value in step c), d) and/or e) is changed after the person has performed a pre-determined number of the same type of exercises. This especially relates to the first sensor signal. In general, by this the person can receive another form of training feedback. The basis of this is that the average deviation of the signals from the ideal signals is recorded for certain or all stages of the exercise. After reviewing, a therapist can then change the pre-determined value in order to reflect training success or the lack of such. For example, if the rotation of the hip during the last 10 performances of an exercise for addressing lower back pain has, in average, deviated by 10% from the ideal value and the current deviation threshold is at 15%, the therapist can manually lower the range of acceptable deviation to 10% or even less. This adaptation can not only be undertaken manually, but also automatically to continuously narrow the ranges of acceptable deviation and thus to influence the person to perform the exercise more precisely.

In a further embodiment of the process according to the present invention the person further receives feedback when the end of an exercise has been recognized. The feedback can be communicated to the user in the form of vibrational, optical or audio signals, for example in speech form. The person can benefit from feedback given to him when the end of an exercise has been reached. Then the person can relax or recapitulate the past exercise.

The present invention is further directed to a system for monitoring exercise motions of a person, comprising a signal processing unit, a plurality of sensors being in communication with the signal processing unit, the sensors being selected from the group comprising movement sensors, physiological activity sensors, muscle activity sensors and/or respiratory sensors; furthermore comprising a communication unit in communication with the signal processing unit and a memory unit in communication with the signal processing unit, wherein the memory unit comprises signal templates and ranges of acceptable deviation from the signal templates. It is possible to conduct the process for monitoring exercise of a person according to the present invention with this system.

The sensors serve to supply the system with data of the person which is needed to monitor the exercise. Examples for movement sensors are magnetometers, gyroscopes, accelerometers or integrated motion sensors where several or all of these components are combined. Examples for physiological activity sensors are electrocardiographical sensors, pulse sensors, blood oxygen sensors, blood pressure sensors, body temperature sensors and sensors measuring the electrical conductivity of the skin. These sensors provide information on the overall status of the person, for example if the person is fatigued, sweating or in state of overexertion. Muscle activity sensors can be electromyographical sensors where the contraction of a muscle is detected and measured. Respiratory sensors can be piezoelectric devices worn around the person's chest. They can sense the expansion and contraction of the person's thorax. An example would be a piezoelectric textile strip. Via wired or wireless means, the latter including infrared, bluetooth and IEEE 802.11 protocols, the sensors transmit their signals to the signal processing unit.

The signal processing unit can perform basic operations on the signals such as noise filtering and signal smoothing. It can also undertake advanced operations by calculating a representation of the person's posture and movements in the form of an avatar. The signal processing unit is equipped to monitor or process multiple sensor signals simultaneously. For example, it may process the signals of one, two, three four or five motion sensors, a pulse sensor, an electromyographical sensor and a respiratory sensor at the same time. By accessing the memory unit the signal processing unit can compare signals to templates, calculate deviations from templates and evaluate the comparison result. The evaluation could be counting the amount of motions performed or calculating a mean deviation of the signals from the templates.

The communication unit is addressed by the signal processing unit when the person performing the exercises needs to be informed of something. The communication unit then serves the task of informing the person. For example, the person can be informed that the exercise is not done correctly. This can be in the form of vibrational, optical or audio signals. The audio signals can be simple sounds like beeps and vary their volume or frequency. By way of example, the frequency of the signal can rise in frequency the more the person's movements deviate from the ideal exercise template. The audio signals can also be speech messages giving the person detailed hints on how to exercise correctly.

A further function of the communication unit is to serve as a user interface so that the signal processing unit and the memory unit can be programmed, serviced or updated. For example, a physical therapist might access the memory unit to observe the course of exercises of the person during regular visits or remotely via the internet. The person can also manually select a first sensor signal to be monitored.

The memory unit is also in communication with the signal processing unit. Firstly, the memory unit comprises signal templates. These templates describe how the signal of the sensor should be if the exercise is performed correctly. As the exercise is performed in a certain time, the sensor template will also describe the temporal variation or non-variation of the sensor signal. A template may represent one sensor signal or a group of sensor signals. Within a group of signals in a template it still possible to access an individual signal for comparison. For the generation of the templates they can be calculated or recorded during a supervised exercise. Furthermore, the signal templates can also reflect the situation that a person is in a starting position for beginning the exercise and the situation that the person has finished the exercise.

Furthermore, the memory unit also comprises information about how much, during the course of an exercise, the signals should be allowed to deviate from the signals representing an ideal exercise for the exercise still being able to be called successful. It is especially important for, but not limited to, signals which are selected as first signals according to the process of the invention. This is the range of acceptable deviation. The range may be stored as an individual number for the respective signals, for example permitting a deviation of 5%, 10% or 15% from the signals. The deviation may be the same or different for the signals of the various sensors. The range may also be combined with the sensor signal templates so that the sensor signals in the templates do not represent a distinct signal but rather a signal corridor.

In one embodiment of the system according to the present invention the plurality of sensors is an electromyographic sensor, a piezoelectric respiratory sensor and five motion sensors, the motion sensors each being combinations of magnetometers, gyroscopes and accelerometers. The electromyographic (EMG) sensor can be worn on the muscles of the abdomen. The piezoelectric respiratory sensor can be worn around the chest of the person undertaking the exercise to monitor the expansion and contraction of the thorax. The motion sensors can be worn on each of the lower arms and legs and, for the fifth sensor, on the hip. Such a system is well suited for monitoring exercises for addressing lower back pain where a steady breathing rhythm and the contraction of abdominal muscles while resisting torsion of the hip are important.

In a further embodiment of the system according to the present invention the sensors are in communication with the signal processing unit via the electrical conductivity of the human body. In other words, instead of a wired connection the sensors transmit their signals through the body of the person performing the exercise. It is possible for all of the sensors or only a selection of sensors to use this means of communication. These sensors can then be viewed as being part of a body area network. An advantage of this type of communication is that the sensors use less power when transmitting their signals compared to wireless transmission and the need for wires on the person is eliminated.

A further aspect of the present invention is the use of a system according to the present invention for monitoring exercise motions of a person. The system of the present invention can especially be used in exercises addressing lower back pain.

BRIEF DESCRIPTION OF THE DRAWINGS

Referring now to FIG. 1, a system for monitoring exercise motions of a person according to the present invention is shown. The system comprises a signal processing unit 1 which is in communication with a communication unit 2. The signal processing unit 1 is also in communication with a memory unit 3. This memory unit 3 comprises signal templates 4 and also information about which range of deviation from the signal template is deemed appropriate 5. Movement sensor 6, pulse sensor 7, electromyographical sensor 8 and respiratory sensor 9 transmit their signals to the signal processing unit 1.

Figure 1:
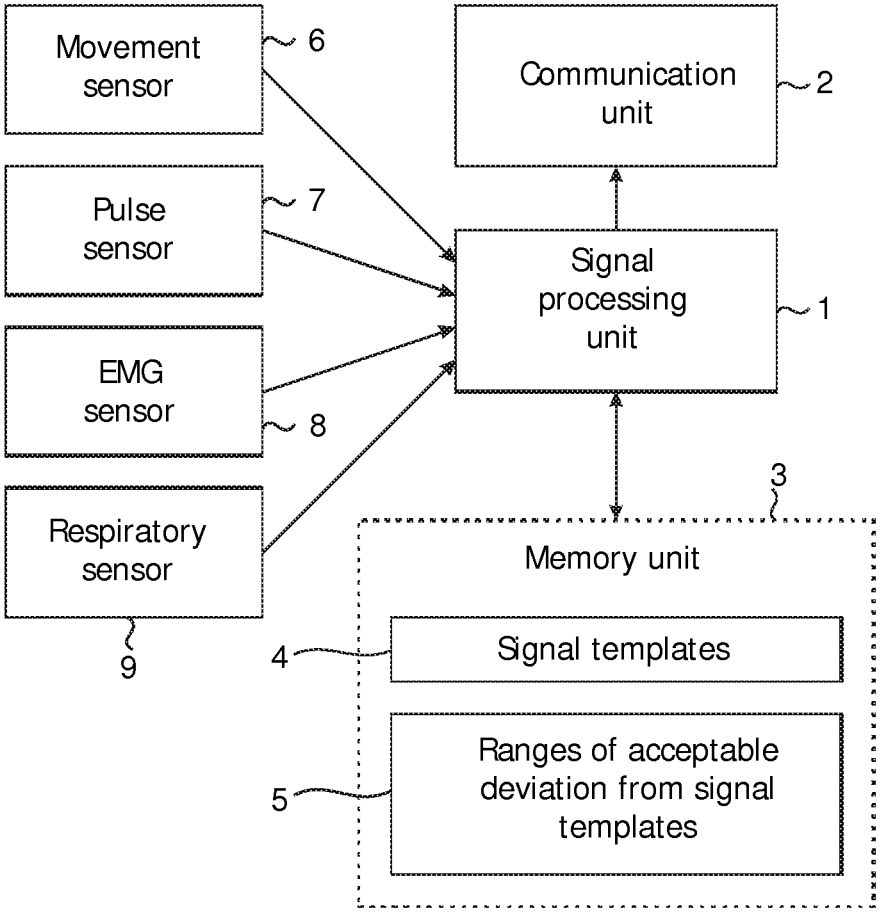
FIG. 1 shows a system according to the present invention.
Figure 2:
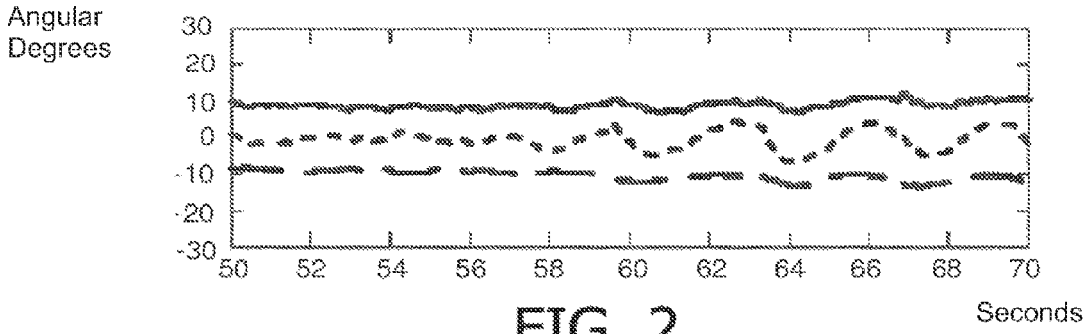
FIG. 2 shows angular data of a sensor on a person's hip
Figure 3:
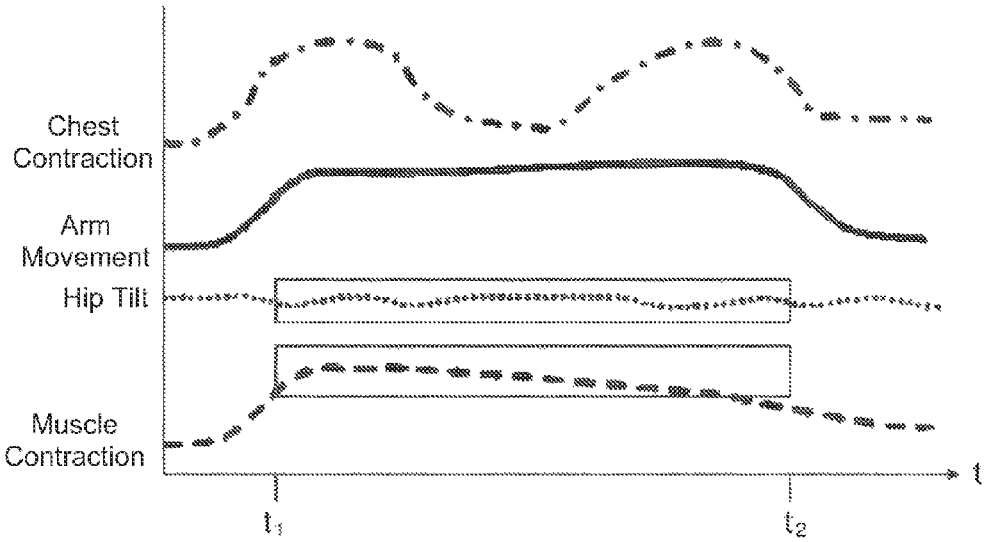
FIG. 3 shows several sensor signals in the course of performing an exercise

As FIGS. 2 and 3 relate to a person performing an exercise, the specific exercise shall briefly be described beforehand. The exercise is typical for a person to perform in the treatment or prevention of lower back pain. It requires the person to move a leg while maintaining the posture in the hip and controlling the breath. The first step is to kneel on the hands and the knees, with the knees under the hip and the hands underneath the shoulders. Then, while breathing in, opposite hands and feet are slid along the floor. Both hand and foot are lifted lightly. The abdominal muscles should remain contracted. Finally, while breathing out, hand and foot are returned to the starting position. This exercise requires coordination between movements, abdominal muscle contraction and breathing.

FIG. 2 shows angular data of a combined motion sensor on a person's hip while the person is performing the above-mentioned exercise. The y-axis is in the unit of angular degrees. The x-axis shows a time scale to represent the course of the experiment given in seconds. Three lines are shown in the diagram. The top line, a full line, represents the sideways motion of the sensor and thus also of the person's hip. The line below that, an evenly dashed and spaced line, represents the torsion of the sensor relative to the longitudinal axis of the person. The sensor itself is placed at the person's os sacrum. Returning to the diagram, the bottom line represents the forward and backward motion of the sensor. Up to a time of about 59 seconds into the exercise the three lines show a substantially flat profile, indicating no pronounced movement of the sensor and, in conclusion, a stable position of the hip. The trunk of the person is stable and the exercise is performed correctly. In the second half of the exercise, after about 59 seconds, the hip is raised outwards as the leg is raised. This is represented by the oscillations of the graph depicting the torsion of the sensor. In this position the person's trunk is instable and the exercise is ineffective.

FIG. 3 shows signals of a combination of sensors on the person's body during the course of a complete exercise. This can be regarded as a signal template for this exercise, grouping individual signals. The top line represents the breathing motion as the expansion and contraction of the person's chest is monitored. The solid line below represents the motion of an arm, more specifically the raising or lowering of an arm. The dotted line beneath that represents the tilt of the hip which has already been encountered in FIG. 2. The lowest line represents the level of contraction of the of the person's abdominal muscles. Around the lines for the hip tilt and the abdominal muscle contraction are boxes indicating the allowed range for the signal without rendering the exercise ineffective. The tilt of the hip has been selected as first sensor signal in the terminology of the process according to the present invention.

The exercise begins at the time $t_1$. Then the arm is raised, the abdominal muscles are contracted and the person is breathing in. While the person is breathing in and out, the raised arm is kept at a steady height while moving the arm forward. Likewise, the tilt of the hip is kept steady, meaning that the person does not rotate the hip while extending the respective leg outwards. The tilt of the hip does not leave the boundary box around it. The contraction of the person's abdominal muscles declines steadily after the beginning of the exercise. At one point, the line leaves the boundary box. Now the exercise would not be effective anymore. However, as the range of acceptable deviation is left, a correctional feedback is given to the person, indicating that he is not trying hard enough. The exercise concludes at the time $t_2$. The end of the exercise is recognized when the person completes a second cycle of breathing in and out and lowers the arm. In this example, both the rotation of the hip and the contraction of the abdominal muscles are selected as first or lead sensor signals. Therefore, at the moment the contraction of the abdominal muscles leaves its acceptable range the evaluation of the exercise is stopped and it can be determined that this performance will not count as successful.

To provide a comprehensive disclosure without unduly lengthening the specification, the applicant hereby incorporates by reference each of the patents referenced above.

The particular combinations of elements and features in the above detailed embodiments are exemplary only; the interchanging and substitution of these teachings with other teachings in this and the patents/applications incorporated by reference are also expressly contemplated. As those skilled in the art will recognize, variations, modifications, and other implementations of what is described herein can occur to those of ordinary skill in the art without departing from the spirit and the scope of the invention as claimed. Accordingly, the foregoing description is by way of example only and is not intended as limiting. The invention's scope is defined in the following claims and the equivalents thereto. Furthermore, reference signs used in the description and claims do not limit the scope of the invention as claimed.

The invention claimed is:

1. A method for monitoring exercise motions of a person performing a corresponding exercise, the method comprising the steps of:

a) selecting a first sensor signal, the first sensor signal originating from a first sensor configured to detect data of the person to monitor the exercise while the person is performing the exercise motion, the first sensor being selected from the group consisting of movement sensors, physiological activity sensors, muscle activity sensors and respiratory sensors;

b) monitoring the first sensor signal and comparing the first sensor signal to a first sensor signal template stored in a memory unit and determining via a signal processing unit whether the first sensor signal deviates from the first sensor signal template by more than a pre-determined value to determine whether the person is performing the exercise correctly with respect to the first sensor signal;

c) when the first sensor signal does not deviate from the first sensor signal template by more than the pre-determined value, performing a procedural loop comprising the steps of:

monitoring at least one further signal originating from at least one further sensor configured to detect data of the person to monitor the exercise while the person is performing the exercise motion and being selected from the group consisting of movement sensors, physiological activity sensors, muscle activity sensors and respiratory sensors;

comparing the at least one further signal from the at least one further sensor to at least one further sensor signal template stored in the memory unit representing the exercise the person is performing; and evaluating the comparison result via the signal process unit to determine whether the at least one further sensor signal deviates from the at least one further sensor signal template by more than a further pre-determined value to determine whether the person is performing the exercise correctly with respect to the at least one further sensor signal;

d) communicating to the person performing the exercise when he first sensor signal deviates from the first sensor signal template by more than the pre-determined value; and e) communicating to the person performing the exercise when the at least one further signal deviates from the at least one further sensor signal template by more than the further pre-determined value.

2. The method according to claim 1, further comprising the following step:

f) comparing one of the first signal to the first sensor signal template and the at least one further signal the at least one further sensor signal template for identifying whether a condition indicating the end of the exercise has been met.

3. The method according to claim 1, further comprising communicating to the person that the exercise should not be continued when physiological data from at least one of the first sensor and the at least one further sensor exceed a predetermined limit.

4. The method according to claim 1, wherein the predetermined value or the further pre-determined value in at least one of step b), c), d) and e) varies in magnitude over the course of the exercise.

5. The method according to claim 1, wherein the magnitude of the pre-determined value or the further pre-determined value in at least one of step b), c), d) and e) is changed after the person has performed a pre-determined number of the same type of exercises.

6. The method according to claim 1, further comprising automatically providing feedback to the person when the end of an exercise has been recognized.

7. A system for monitoring performance of an exercise by a person, the system comprising:

a signal processing unit;

a plurality of sensors in communication with the signal processing unit and configured to generate a plurality of signals providing parameters indicating physical responses of the person performing the exercise, the sensors comprising a physiological activity sensor and at least one of a movement sensor, a muscle activity sensor and a respiratory sensor, the parameters being using for monitoring the performance of the exercise; and a memory unit in communication with the signal processing unit and configured to store a plurality of signal templates corresponding to the plurality of signals and acceptable deviations of the plurality of signals from the signal templates, respectively, each signal template providing an ideal value of the corresponding signal for performing the exercise correctly, wherein the signal processing unit is configured to determine successful completion of the exercise by comparing a first sensor signal with the corresponding template to determine whether an amount of deviation of the first sensor signal from the corresponding template is within the acceptable deviation stored in the memory unit, and when the first sensor signal is within the acceptable deviation, performing a procedural loop for comparing a second sensor signal with the corresponding template.

8. The system according to claim 7, wherein the plurality of sensors comprises an electromyographic sensor, a piezoelectric respiratory sensor and five motion sensors, the motion sensors each being combinations of magnetometers, gyroscopes and accelerometers.

9. The system according to claim 7, wherein the plurality of sensors are in communication with the signal processing unit via electrical conductivity of the body of the person.

10. The system of claim 7, further comprising:

a communication unit in communication with the signal processing unit and configured to warn the person when each signal is not within the acceptable deviation from the corresponding template.

11. The system of claim 7, wherein the communication unit is further configured to inform the person that the exercise has been successfully completed when each signal is within the acceptable deviation from the corresponding template over an exercise period.

12. The system of claim 7, wherein the communication unit is further configured to infirm the person to stop the exercise when at least one of the plurality of signals exceeds a predetermined threshold.

13. The system of claim 12, wherein the at least one of the comparison results indicates one of high pulse rate, high blood pressure, sweating and irregular heart beat.

14. The system of claim 7, wherein a range of the amount of deviation of at least one of the signals from the corresponding template is automatically narrowed upon successful completion to assist the person to subsequently perform the exercise more precisely.

15. A system for monitoring performance of an exercise by a person, the system comprising:

a signal processing unit;

a first sensor in communication with the signal processing unit and configured to generate a first signal providing parameters indicating responses of the person performing the exercise, the first sensor comprising a physiological activity sensor;

a second sensor in communication with the signal processing unit and configured to generate a second signal providing parameters indicating responses of the person performing the exercise, the second sensor comprising one of a movement sensor, a muscle activity sensor and a respiratory sensor, the parameters being using for monitoring the performance of the exercise; and a memory unit in communication with the signal processing unit and configured to store a first signal template corresponding to the first signal and a first acceptable deviation of the first signal from the first signal template, and to store a second signal template corresponding to the second signal and a second acceptable deviation of the second signal from the second signal template, each of the first and second signal templates providing an ideal value of the corresponding first and second signals for performing the exercise correctly, wherein the signal processing unit is configured to compare the first signal with the first signal template to determine whether an amount of deviation of the first signal from the first signal template is within the first acceptable deviation stored in the memory unit, and when it is determined that the first signal is within the first acceptable deviation, to compare the second signal with the second signal template to determine whether an amount of deviation of the second signal from the second signal template is within the second acceptable deviation stored in the memory unit, and wherein the signal processing unit is further configured to determine that the exercise is successfully completed when both the first signal is determined to be within the first acceptable deviation and the second signal is determined to be within the second acceptable deviation.

* * * * *